US005559487A

United States Patent [19]

Butcher et al.

[11] Patent Number: 5,559,487

[45] Date of Patent: Sep. 24, 1996

[54] WINDING CONSTRUCTION FOR USE IN PLANAR MAGNETIC DEVICES

[75] Inventors: Jerry L. Butcher, Chesterland; Harold E. Lee, Lorain, both of Ohio

[73] Assignee: Reltec Corporation, Lorain, Ohio

[21] Appl. No.: 241,176

[22] Filed: May 10, 1994

[51] Int. Cl.[6] ..... H01F 15/10; H01F 27/30

[52] U.S. Cl. ..... 336/178; 336/83; 336/192; 336/205; 336/198

[58] Field of Search ..... 336/198, 205, 336/178, 83, 65

[56] References Cited

U.S. PATENT DOCUMENTS

| | | | |
|---|---|---|---|
| 2,780,742 | 2/1957 | Jenner et al. | 310/79 |
| 3,609,859 | 6/1969 | Hunt et al. | 29/605 |
| 3,939,450 | 2/1976 | Donnelly | 336/90 |
| 4,313,151 | 1/1982 | Vranken | 361/402 |
| 4,322,698 | 3/1982 | Takahashi et al. | 333/184 |
| 4,482,874 | 11/1984 | Rubertus et al. | 333/185 |
| 4,538,132 | 8/1985 | Hiyama et al. | 336/221 |
| 4,543,553 | 9/1985 | Mandai et al. | 336/83 |
| 5,010,314 | 4/1991 | Estov | 336/198 |
| 5,179,365 | 1/1993 | Raggi | 336/65 |
| 5,359,313 | 10/1994 | Watanabe et al. | 336/178 |

*Primary Examiner*—Leo P. Picard
*Assistant Examiner*—G. R. Lord
*Attorney, Agent, or Firm*—Fay, Sharpe, Beall, Fagan, Minnich & McKee

[57] ABSTRACT

A conductive winding electrically isolated by reflowable material which is incorporated into a transformer further including individual layers of electrical insulation material. The transformer is formed in a layered configuration wherein isolation requirements set forth by safety certification agencies are met through the use of the reflowable material and insulation layers.

21 Claims, 4 Drawing Sheets

WINDING CONSTRUCTION FOR USE IN PLANAR MAGNETIC DEVICES

BACKGROUND OF THE INVENTION

The present invention relates generally to isolation of conductive windings. It finds particular application in conjunction with low-profile planar magnetic devices such as transformers and inductors constructed to meet existing isolation standards. Use of isolated windings produced according to the present invention allows construction of smaller sized low-profile planar transformers and inductors capable of handling voltages previously handled by larger devices. It is to be appreciated, however, that the invention has broader application and may be employed in other environments.

As the size of electronic components have decreased the size of devices incorporating those components have correspondingly decreased. Regulated switching power supplies have, for example, particularly benefitted from such advancements. These power supplies are well known for their high efficiency, cool operation, small size, and ability to work with a wider range of input voltages than their linear counterparts. As the size of the power supplies have decreased the miniaturization of the magnetic devices used in conjunction with the power supplies have also become a requirement.

In designing planar magnetic devices, stringent isolation requirements which meet safety standards developed by recognized safety agencies must be met. Isolation, however, is largely an issue of separation and insulation between conductors and connections. This separation and insulation works against size reduction. Therefore, a trade-off exists between the miniaturization desired and the linear distance needed to meet existing isolation requirements.

While the desire to minimize the distances between the conductive elements in low-profile planar magnetic devices and thereby reduce the overall size of the devices exists, there has been an inability to obtain desired size reductions and also satisfy the isolation safety requirements. This in turn has limited the use of designs which provide for small, light weight, low-profile planar magnetics such as transformers and inductors. Therefore, the challenge facing designers of low-profile planar magnetics is to meet the isolation safety requirements and yet construct miniaturized devices which can be incorporated into power supplies and other electronic devices which themselves have been downsized.

As the power supply industry has evolved into a global market the safety agencies for this market have harmonized their requirements. The safety agencies in North America, Underwriters' Laboratories in the United States and the Canadian Standards Association in Canada along with the European Community countries have based their requirements on those established by the International Electro-Technical Commission (IEC). The Information Processing Equipment, IEC 950, standard has been used extensively for harmonizing the standards applied to evaluate equipment that provides isolation from the AC mains and operators or users of equipment. This standard requires the use of reinforced isolation between the AC mains and user accessible terminals.

Reinforced isolation requirements can be met by using any one of the following methods for circuits operating from mains up to 250 VAC: 1) through air spacing of 4 mm (0.16 inch); 2) over surface spacing of 8 mm (0.32 inch), this is a worst case spacing and may be reduced to 5 mm (0.20 inch) for controlled environment applications; 3) three layers of insulation (no minimum thickness requirements), with any combination of two layers supporting the dielectric test levels required for the circuit; 4) solid insulation with a minimum thickness of 0.4 mm (0.016 inch) void free (no air bubbles); and 5) over surface spacing which may be reduced to 1.2 mm (0.048 inch) when a suitable conformal coating that provides a minimum of 80% coverage of the space between conductors is used. The aforementioned isolation methods are tested to safety agency requirements which include temperature cycling, humidity testing and dielectric testing to assure compliance.

U.S. Pat. No. 5,010,314 to Estrov addresses the challenge facing low-profile planar transformer designs. Estrov ('314) attempts to meet the safety agency requirements through the use of a bobbin design which is incorporated into a sandwich-like-laminent of dielectric insulators, spacers, windings and bobbins enclosed by a magnetic housing made of a core material. While some decrease in size may be obtained by such a construction the edges of the Estrov device are open ended, i.e. unsealed, and a bobbin is maintained within the transformer design. Constructing a device with open edges, and maintaining the bobbin, along with the other required elements results in a transformer having dimensions which are unacceptably large for incorporation into designs such as those found in circuit board layouts.

It has, therefore, been considered desirable to provide isolated conductive windings with sealed bonded edges constructed according to the present invention. These windings can then be used in low-profile planar magnetic devices that eliminate the use of bobbins and which meet existing safety requirements, in a reduced physical size. Such isolated windings may be used in low-profile planar transformers or inductors reducing their overall size, resulting in smaller transformers and inductors which can nevertheless handle voltages previously handled by larger sized devices. Such devices should be economical to manufacture and be of a sturdy overall construction. The subject invention is deemed to meet the foregoing needs and others.

SUMMARY OF THE INVENTION

In accordance with the subject invention, an electrically isolated conductive winding is provided which meets or exceeds existing safety agency isolation requirements. The winding is electrically isolated by placing reflowable material on each surface of the winding. Then a predetermined heat and mechanical pressure is applied causing the reflowable material to initially flow over the edges of the winding and thereafter cure into a hardened mass of material sealing the winding. The application of the heat and pressure can be applied in a vacuum environment to remove voids of trapped gas and to ensure complete bonding. Windings constructed in this manner are then used in a low-profile magnetic devices such as a transformer assembly having a reduced overall size. Such a transformer assembly may include at least first and second isolated windings with insulation material disposed adjacent the surfaces of the first and second isolated windings. A core material is inserted into apertures of the above elements. The core material defines a magnetic path linking the first and second windings.

In accordance with a more limited aspect of the invention, the insulation material includes (i) first, second and third insulation layers disposed adjacent a surface of a first reflowable material opposite the first winding; (ii) fourth, fifth and sixth insulation layers between second and third reflowable material; and (iii) seventh, eighth and ninth insulation layers disposed adjacent the surface of the second reflowable material opposite the second winding.

In accordance with another feature of the invention, the insulation layers are formed in groups of polyimide films, two layers of each group having a thickness capable of meeting safety agency dielectric requirements.

In accordance with a further aspect of the invention, one layer of each group of insulation layers includes on its surface the reflowable material thereby acting as a carrier for the material.

In accordance with still another aspect of the invention, the edges of the first winding is isolated by reflowable material which seals the winding with at least 16 mills of resin polymer measured from the edges of the first winding.

In accordance with yet another feature of the present invention, a plurality of windings, in addition to the first and second windings, are included in the apparatus. Each of the plurality of windings being sealed with reflowable material.

A principle advantage of the present invention is sealing a winding in a single fused bonded mass to meet or exceed electrical isolation requirements.

Another advantage of the invention resides in an assembly which minimizes the profile and overall size of a low-profile planar transformer while meeting or exceeding electrical isolation requirements.

Yet another advantage of the invention is the provision of a low-profile planar transformer whose construction process is simplified and which is inexpensive and easy to manufacture.

Still yet another advantage of the invention is a low-profile planar transformer which is constructed without a bobbin element and which meets or exceeds the creepage and clearance isolation requirements.

Still other advantages and benefits of the invention will become apparent to those skilled in the art upon a reading and understanding of the following detailed description.

BRIEF DESCRIPTION OF THE DRAWING

The invention may take form in certain parts and arrangements of parts, a preferred embodiment of which will be described in detail in this specification and illustrated in the accompanying drawings which form a part hereof and wherein.

DETAILED DESCRIPTION OF THE PREFERRED EMBODIMENT

Figure 1A:
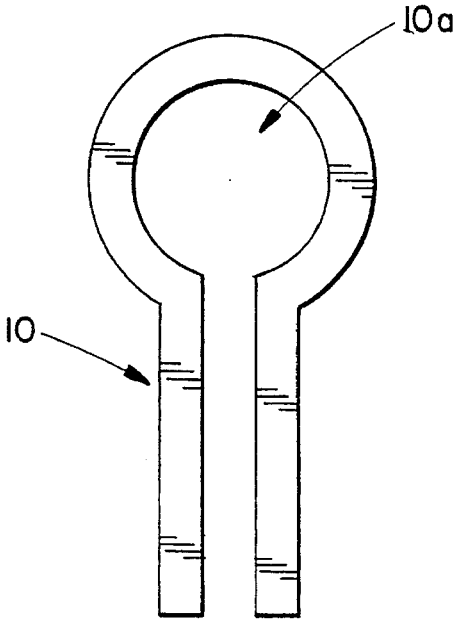
FIG. 1*a* is a top view of a single turn winding having a planar profile, processed from a strip of conductive material.

Referring now to the drawings wherein the showings are for purposes of illustrating the preferred embodiment of the invention only and not for purposes of limiting the same.

Figure 1B:
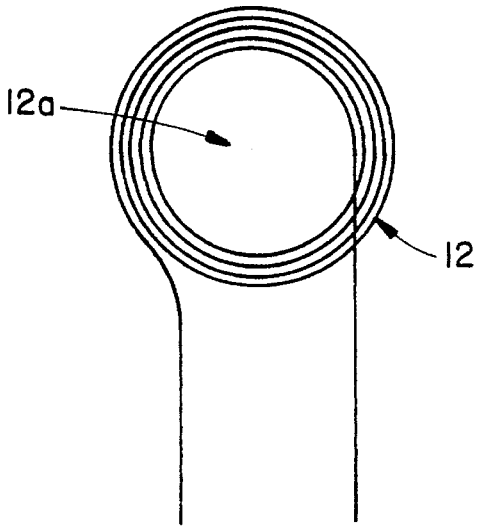
FIG. 1*b* is a top view of a spiral multi-turn winding having a planar profile made out of wire.

FIGS. 1*a* and 1*b* show windings having planar or flat profiles which may be used for the windings in the present embodiment. FIG. 1*a* sets forth a single turn winding 10 having an aperture 10*a*. Winding 10 is formed from a thin layer of copper through etching, stamping or other such processes. The winding 12 with aperture 12*a* depicted in FIG. 1*b* is constructed of wire formed in a spiral configuration. Each portion of the wire is immediately adjacent the next portion to achieve a planar profile.

Figure 2A:
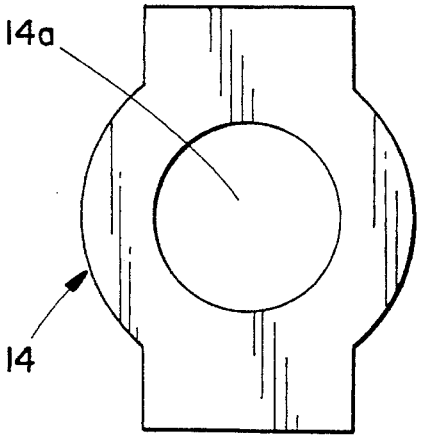
FIG. 2*a* is a top view of a configuration of a washer of insulating material used to carry reflowable material.
Figure 2B:
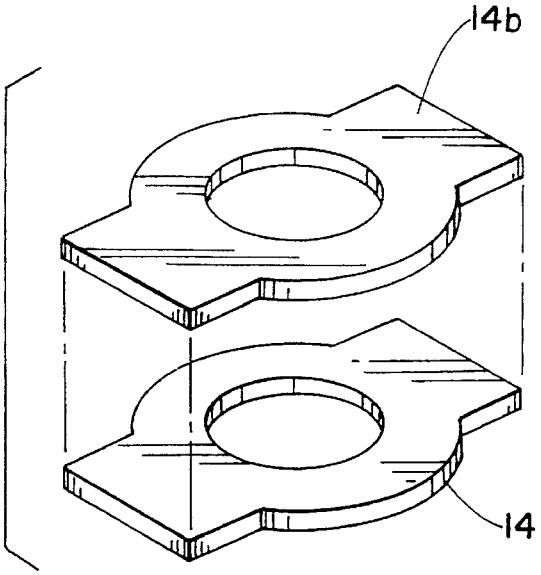
FIG. 2*b* provides a view of the insulation layer and the reflowable material carried thereon.

An insulation layer of the present invention may be configured as washer 14 of FIG. 2*a*. As may be noticed from this figure, washer 64 is not constructed to be identical to the form of the windings. Rather, the washer is sized somewhat larger than a winding, overlapping the winding and including an aperture 14*a*. It is to be appreciated from FIG. 2*b* that reflowable material 14*b* is carried on washer 14. This feature is shown by the connecting dotted lines. It should be noted FIG. 2*b* is not drawn to scale. In an embodiment the reflowable material may be thicker than the insulation layer. The use of insulation layers to carry the reflowable material is desirable due to the fluid nature of the reflowable material. Another possible manner of carrying the reflowable material is to impregnate a carrying layer in the same configuration of the insulation layer, e.g. washer of FIG. 2*a*.

The reflowable material carried on the above discussed insulation layer is a resin polymer which has been preliminarily flowed and is known as B-stage material. B-stage material is a resin polymer which is viscous, with high molecular weight, and which is insoluble but plastic and fusible. Applying a predetermined heat and pressure causes the reflowable material to re-enter a more liquid state allowing the pressure to redistribute the material. When the heat and mechanical pressure reach a predetermined level the B-stage material will enter a cure stage which causes the material to set into a solid fused material. In the present invention the heat and mechanical pressure is applied to the B-stage material in a vacuum environment to remove voids of trapped gas and to ensure complete bonding.

It is to be appreciated that other washer configurations may be used which are appropriate for the windings which are being sealed. The insulation layers may be made of any product having appropriate insulative dielectric properties which meet standards set by the governing safety agencies. In the present embodiment a polyimide film is used which is capable of withstanding temperatures of up to 400° C. and high amounts of pressure. Each layer of polyimide film is 1 mil in thickness and is rated to meet agency requirements. One product which meets these requirements is a polyimide film sold under the trademark (KAPTON) a product of E.I. Dupont DeNemours and Company. It is to be appreciated other types of insulation material may be used to form the insulation layers which meet or exceed the isolation requirements.

Various processes for assembling the elements of the present invention may be employed. With attention to FIGS.

3*a* and 3*b*, a process will be discussed in connection with winding 10 and two insulation layers 14 each carrying reflowable material 14*b*.

Figure 3A:
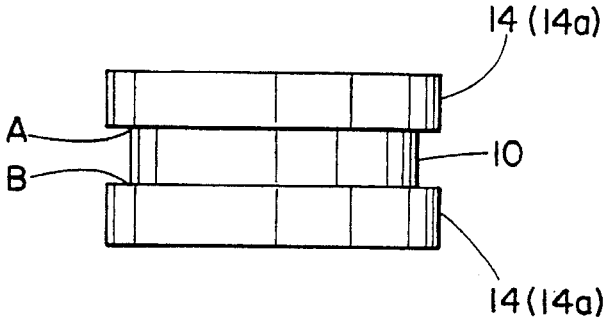
FIG. 3*a* is a front view of a packet having a first winding with reflowable material disposed adjacent to its to surfaces.
Figure 3B:
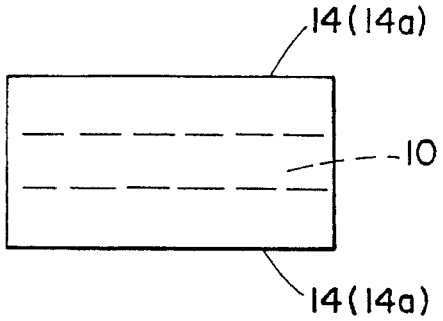
FIG. 3*b* is the packet of FIG. 3*a* after having heat and pressure applied.

FIG. 3*a* shows a front view of a packet having winding 10 and a washer 14 with reflowable material 14*b* immediately adjacent a bottom surface of the first winding and another washer 14 with reflowable material 14*b* immediately adjacent the top surface of winding 10. Prior to applying heat. and mechanical pressure to this packet, there are distinct demarcations A and B between the reflowable material 14*b* and winding 10. FIG. 3*b* shows the packet after predetermined mechanical pressure and heat have been applied. In FIG. 3*b* the dotted lines represent winding 10 which has been sealed in the reflowable material 14*b*, carried on washers 14, which during the reflowing process both of the layers of reflowable material flowed and fused together to seal winding 10.

Figure 3C:
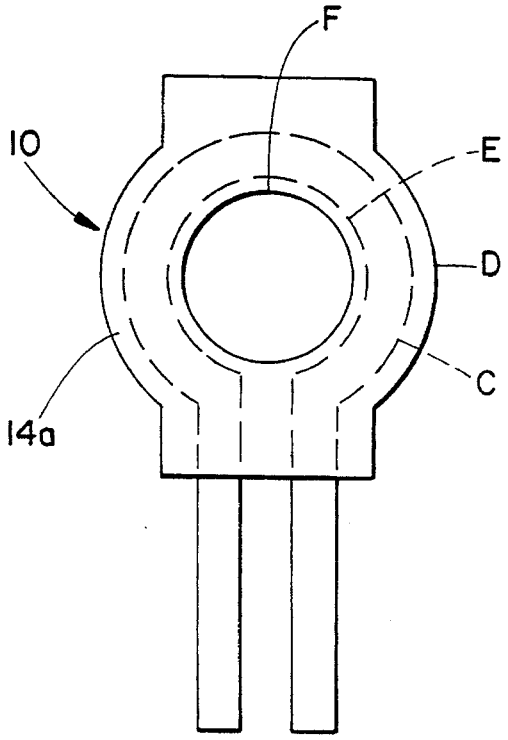
FIG. 3*c* is a top view of a single turn winding enclosed in the reflowable material.

As depicted in FIG. 3*c*, the edge of winding 10, for example the single turn copper winding, is sealed within the reflowed and fused reflowable material 14*b*. The distance from the outer edge C of winding 10 to the outer end D of the fused and bonded layers of reflowable material 14*b*, carried on washers 14, is at least 16 mils (0.4 mm) (not to scale in the Figure). It is also noted that the inner edge E of winding 10 has also been sealed, with at least 16 mils (0.4 mm) F (not to scale in the Figure) of the reflowable material due to the fusing and bonding of the layers of reflowable material 14*a*.

In the process, as heat and pressure are applied to the packet of FIG. 3*a*, the layers of reflowable material 14*b* are forced both to the outer edge C and inner edge E of the winding 10. The material flows over these edges allowing for the fusing and bonding between the layers of reflowable material 14*a*. As the heat continues to rise, the reflowable material enters a cure stage and sets into a solid state, providing the fused bonded seal. The critical temperature for the B-stage material is approximately 200° C., upon reaching this temperature curing begins in about 10 seconds and the material is 100% cured in under 2 minutes.

It is to be appreciated that B-stage material having other critical temperatures and cure times may be used. It is also worth noting that simply using an adhesive material to seal the edges of a winding would not meet the isolation requirements under Underwriters' Laboratories specifications and that of other safety agencies.

The above disclosed sealing operation meets the creepage distance requirements defined by the safety certification agencies since the winding is sealed as a single fused mass. An alternative manner to obtain the required distance between the conductive elements would be to provide air distance between the conductive elements. However, by sealing the edges of the conductive windings with the reflowable material, the present invention is able to meet the Underwriters' Laboratories and other safety certification agency standards in a much reduced physical space.

Figure 3D:
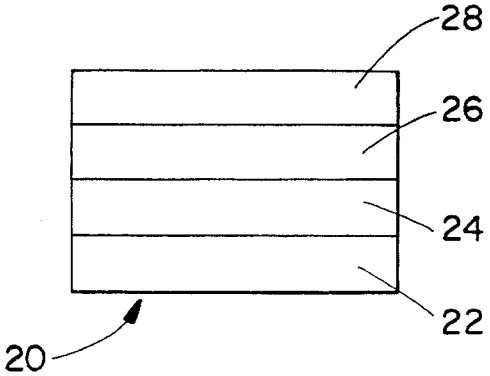
FIG. 3*d* is a front view showing the insulation material and reflowable material formed as a single multilayered washer.

Another process to construct a transformer according to the present invention is to use a multilayered washer as an element of packets which are pressurized and heated. As will be discussed later in greater detail this process can be accomplished in a vacuum environment to remove voids of trapped gas and ensure complete bonding. FIG. 3*d* shows such a multilayer washer 20 having a layer of reflowable material 22, an insulative carrier layer 24, and insulative layers 26 and 28 all formed on washer 20. This washer along with a similarly constructed washer are placed with each having its reflowable material 22 immediately adjacent a winding, (e.g. 10 or 12) whereafter heat and pressure are applied to this packet. The bonding between the reflowable material of the washers reacts similar to that as previously discussed. However, in the present process by using multilayer washers 20 less processing steps are necessary for construction of a transformer.

Still another process which may be used is to set the multilayer washers 20 in a stacked arrangement having a plurality of windings with multilayer washers 20 on opposite sides of the windings. All the windings and associated washers are pressurized and heated in a single operation. In this operation the flowing of the reflowable material not only seals each of the associated windings, but also bonds the entire stacked arrangement together. This further reduces the steps necessary to construct a transformer, producing a single fused mass which is highly durable and increases the ease with which it may be tested. It is to be appreciated that the heat and pressure applied in the above processes may be obtained in many known ways including, the use of a stamp press type device.

Figure 4A:
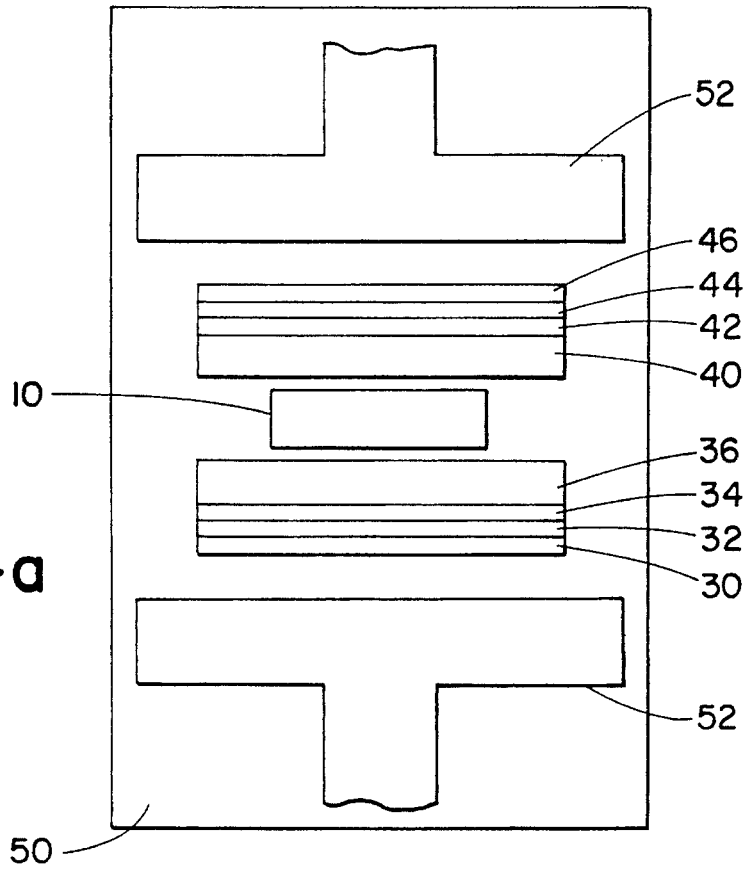
FIGS. 4*a* and 4*b* are side views showing the formation of a single isolated coil in a vacuum environment.
Figure 4B:
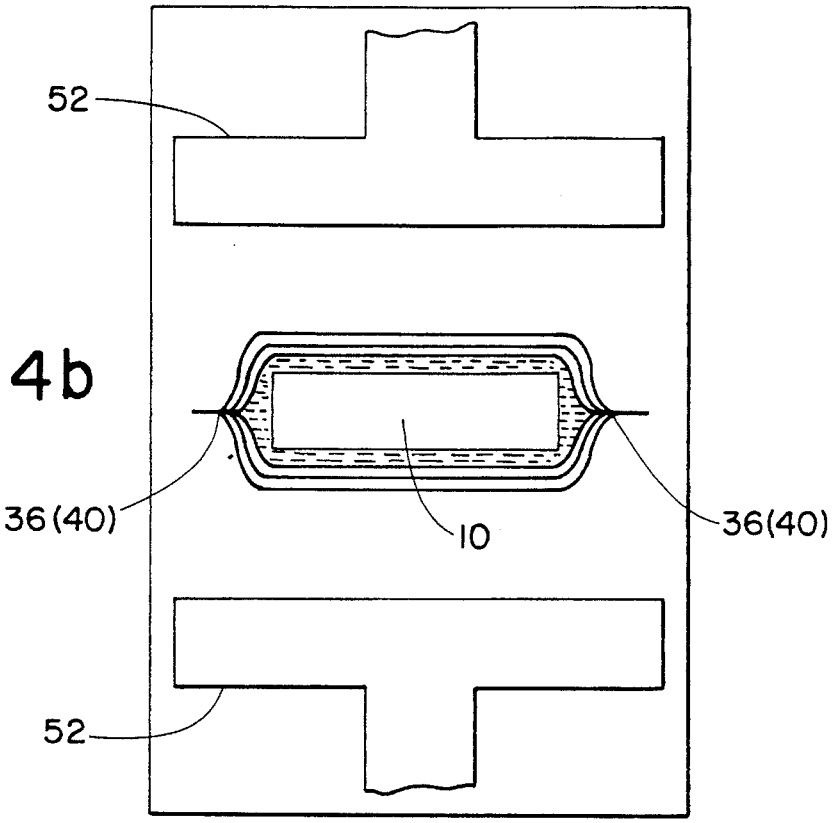

FIGS. 4*a* and 4*b* show side views detailing the formation of a single winding arrangement according to the present invention. In FIG. 4*a* a packet including winding 10 is aligned with insulation layers 30–34 and a layer of reflowable material 36 on one side and insulation layers 42–46 and a layer of reflowable material 40 on the opposite side. This arrangement is placed within a vacuum environment 50. Among other configurations the vacuum environment may be a vacuum chamber or what is commonly known as a "turkey bag". In this vacuum environment heat and mechanical pressure are applied by, for example, the use of a stamp press type device 52. It is to be appreciated other manners of applying heat and mechanical pressure to the single winding and insulation arrangement may be used.

The application of heat and mechanical pressure in the vacuum arrangement assists in removing voids of trapped gas and ensures a complete bonding. This bonding is more clearly depicted in FIG. 4*b* which shows the packet after the stamp press type device has applied pressure and heat and has been removed. The process has bonded and sealed the edges of winding 10 within the B-stage material as B-stage material 36 and 40 have flowed together to form a single unified mass. In an embodiment of the present isolation winding, the insulation layers 30, 32, 34, 42, 44, and 46 may be each of 1 mil thickness and the reflowable material 36 and 40 which is carried on insulation layers 34 and 42, respectively, may be of 3 mils thickness each. This use of reflowable material will ensure the complete bonding and sealing of both the inner edges and outer edges of the winding 10, as previously disclosed in FIG. 3*c*.

Figure 5:
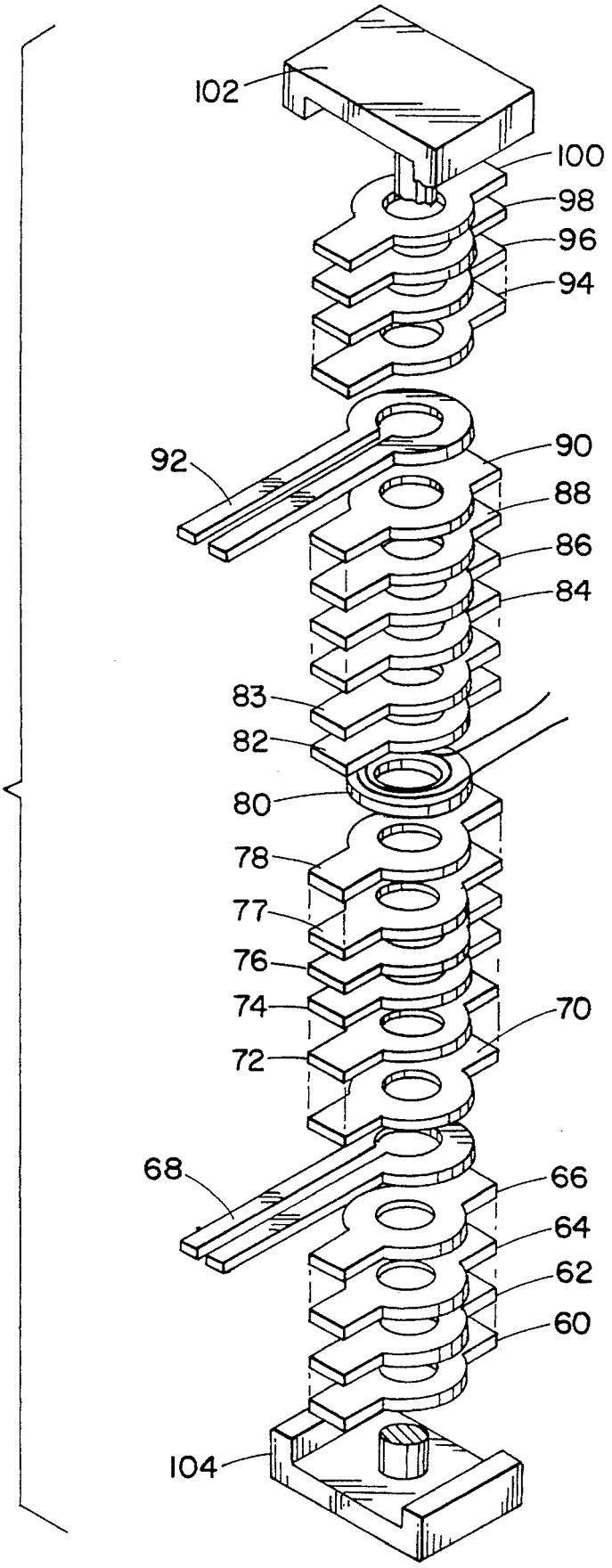
FIG. 5 is an exploded view of an embodiment of a transformer assembly incorporating isolated conductive windings according to the present invention.

FIG. 5 depicts an exploded view of a possible manner of constructing a transformer according to an embodiment of the present invention. The transformer of the present embodiment employs a layer construction technique wherein the elements shown in FIG. 5 are adjacent one another in the final product.

The elements of the transformer include a first set of insulation layers 60, 62 and 64; a first layer of reflowable material 66; a first winding 68 having a planar profile; a second layer of reflowable material 70; a second set of insulation layers 72, 74, 76, and 77; a third layer of reflowable material 78; a second winding having a planar profile 80; a fourth layer of reflowable material 82; a third set of insulation layers 83, 84, 86 and 88; a fifth layer of reflowable material 90; a third winding having a planar profile 92; a sixth layer of reflowable material 94; and a fourth set of insulation layers 96, 98 and 100. On the outer perimeter of the above mentioned elements are core material 102, 104.

In FIG. 5 it is to be appreciated reflowable material 66, 70, 78, 82, 90 and 94 are carried on insulation layers 64, 72, 77, 83, 88 and 96 respectively, this feature is shown by the connecting dotted lines. It should be noted that FIG. 5 is not drawn to scale.

Construction according to the present embodiment includes the use of insulation layers 60, 62, 74, 76, 84, 86, 98 and 100. By inserting these layers of insulation, an isolation of the core from the windings is achieved in accordance with the existing isolation standards. The isolation standard is met since three individual layers (e.g. 60, 62 and 64) are provided and any two of the layers meet agency dielectric requirements.

After the sealed windings and insulation material have been appropriately stacked, such that the central apertures of each of the elements are aligned, the core material is inserted to provide a magnetic path through the first, second and third windings and also acts to maintain the stacked arrangement in a secure arrangement.

It is to be appreciated that a transformer assembly which meets safety agency requirements may also be obtained without the need of reflowable material 78 and 82 or carrier layers 77 and 83.

Irrespective of which of the above processes are used, the concepts of sealing windings within reflowable material, whereby the edges of the windings are sealed in a fused bonded arrangement, and the use of insulation layers having a strength which meets safety agency dielectric requirements, allows for the production of magnetic devices such as transformers which meet or exceed existing isolation requirements. Additionally, by sealing the windings with the reflowable material, devices are constructed having a much smaller physical size than previously obtainable. The size of the transformer of the preferred embodiment is less than 4 cm. in length, 3 cm. in width and 1 cm. in thickness. It is to be appreciated the size of other transformers may be smaller or larger depending upon application requirements and core sizes.

In FIG. 5, the windings 68 and 92 may be considered to be the primary windings with winding 80 as a secondary winding. It is, however, to be understand that any plurality of windings may be incorporated in the transformer constructed according to the present invention, including additional primary and secondary windings. Further, as previously mentioned an inductor may be fabricated using the above described isolation construction.

Although the present disclosure is primarily directed to electrical isolation of planar windings, such an isolation concept is not limited thereto, rather, the concept of using B-stage reflowable material to electrically isolate non-planar windings is also contemplated.

The invention has been described with reference to the preferred embodiment. Obviously modifications and alterations will occur to others upon a reading and understanding of this specification. It is intended to include all such modifications and alterations insofar as they come within the scope of the appended claims or the equivalence thereof.

We claim:

1. A transformer assembly comprising:

a first winding having a first surface and a second surface;

first reflowable material, disposed adjacent the first surface of the first winding;

second reflowable material, disposed adjacent the second surface of the first winding;

a second winding having a first surface and a second surface;

third reflowable material, disposed adjacent the first surface of the second winding;

fourth reflowable material, disposed adjacent the second surface of the second winding;

insulation means disposed adjacent a surface of the first reflowable material opposite the first winding, disposed adjacent a surface of the fourth reflowable material opposite the second winding and between the second and third reflowable material; and a core means inserted into apertures of at least the first winding and the second winding, defining a magnetic path linking the first and second windings.

2. The transformer assembly according to claim 1 wherein the first reflowable material and second reflowable material are disposed adjacent the first winding in an arrangement substantially corresponding to and overlapping the configuration of the first winding, whereby when the first and second reflowable material are reflowed the first and second reflowable material flow together forming a bond which completely seals the first winding, including edges of the first winding, within the reflowable material.

3. The transformer assembly according to claim 2 wherein the edges of the first winding sealed by the bonding of the first and second reflowable material include an inner edge which defines the aperture of the first winding.

4. The transformer assembly according to claim 1 wherein the reflowable material is a resin polymer.

5. The transformer assembly according to claim 4 wherein the first winding is sealed within at least 16 mils of the resin polymer measured from the edges of the first winding.

6. The transformer assembly according to claim 1 wherein the first and second windings have substantially flat planar profiles.

7. The transformer assembly according to claim 1 wherein the insulation means includes:

a first group of first, second and third insulation layers disposed adjacent the surface of the first reflowable material opposite the first winding;

a second group of fourth, fifth and sixth insulation layers between the second and third reflowable material; and a third group of seventh, eighth and ninth insulation layers disposed adjacent the surface of the second reflowable material opposite the second winding.

8. The transformer assembly according to claim 7 wherein at least one layer in each of the first, second and third groups of insulation layers also act as a carrier of the reflowable material.

9. The transformer assembly according to claim 7 wherein the first, second and third insulation layers and first reflowable material are formed as a single multilayered washer.

10. The transformer assembly according to claim 7 wherein the insulation layers are formed from a polyimide film.

11. The transformer assembly according to claim 7 wherein two of the three insulation layers of each group are no greater than 1 mil in thickness.

12. The transformer assembly according to claim 6 wherein any combination of two of the three insulation layers of each group meets safety agency dielectric requirements.

13. The transformer assembly according to claim 1 further including a plurality of windings in addition to the first and second windings, wherein the plurality of windings are isolated by reflowable material which seals each of the plurality of windings with at least 16 mils of resin polymer measured from the edges of each of the windings.

14. The transformer assembly according to claim 4 wherein the resin polymer is a B-stage material.

15. The transformer assembly according to claim 4 wherein the resin polymer includes B-stage characteristics when exposed to a predetermined pressure and heat, the B-stage characteristics being the condition of the resin polymer where it is viscous, with high molecular weight, and is insoluble but plastic and fusible.

16. The transformer assembly according to claim 1 wherein at least one of the first and second windings are configured of spiral wound wire, and wherein when the reflowable material disposed adjacent the spiral wound wire is reflowed voids existing in the winding are filled.

17. A method of electrically isolating a conductive winding comprising the steps of:

placing a first reflowable material immediately adjacent a first surface of the conductive winding;

placing a second reflowable material immediately adjacent a second surface of the conductive winding;

applying a predetermined heat and mechanical pressure to the first and second reflowable material for a predetermined time period, wherein the reflowable material is forced to flow to and over edges of the conductive winding; and sealing the edges of the conductive winding due to bonding action between the first and second reflowable material at the edges.

18. The method of electrically isolating a conductive winding according to claim 17, further including applying the predetermined heat and mechanical pressure in a vacuum environment.

19. A method for forming a transformer comprising the steps of:

forming a first packet by placing a first reflowable material on a first side of a first winding and a second reflowable material on a second side of the first winding;

heating and applying mechanical pressure to the first packet causing the first and second reflowable material to flow to edges of the first winding;

sealing the edges of the first winding due to bonding action between the first and second reflowable material at the edges;

forming a second packet by placing a third reflowable material on a first side of a second winding and a fourth reflowable material on a second side of the second winding;

heating and applying mechanical pressure to the second packet causing the third and fourth reflowable material to flow to edges of the second winding;

sealing the edges of the second winding due to bonding action between the third and fourth reflowable material at the edges; and placing a core material in a physical relationship to the first winding and second winding to define a magnetic path linking the first and second winding.

20. The method for forming a transformer according to claim 19 further comprising the steps of:

placing first insulation means on the sealed first surface of the first winding;

placing second insulation means between the sealed second surface of the first winding and the first surface of the second winding; and placing third insulation means on the sealed first surface of the second winding, wherein each of the first, second and third insulation means include a plurality of layers of a polyimide film with one of said layers carrying the reflowable material.

21. The method for forming a transformer according to claim 19 further including heating and applying mechanical pressure to the first and second packets in a vacuum environment.

* * * * *